United States Patent [19]

Craig

[11] 4,269,442

[45] May 26, 1981

[54] ROOF TRUSS SUSPENSION

[76] Inventor: William R. Craig, 1717 Golden Mile Hwy., Monroeville, Pa. 15146

[21] Appl. No.: 118,574

[22] Filed: Feb. 4, 1980

[51] Int. Cl.[3] ..... B66C 1/14

[52] U.S. Cl. ..... 294/81 R; 294/87 R

[58] Field of Search ..... 294/67 R, 67 DA, 67 DB, 294/67 E, 74, 81 R, 81 SF, 82 R, 87 R; 52/122, 125; 414/10-12

[56] References Cited

U.S. PATENT DOCUMENTS

| | | | |
|---|---|---|---|
| 1,007,663 | 11/1911 | Atterbury | 294/81 R X |
| 1,291,437 | 1/1919 | Desch | 294/81 R |
| 1,762,271 | 6/1930 | Hutchings | 294/67 DA |
| 1,846,038 | 2/1932 | Owens | 294/67 DA |
| 1,970,617 | 8/1934 | Morgan | 294/74 X |

FOREIGN PATENT DOCUMENTS

| | | | |
|---|---|---|---|
| 617563 | 7/1978 | U.S.S.R. | 294/81 R |

*Primary Examiner*—Johnny D. Cherry

*Attorney, Agent, or Firm*—William J. Ruano

[57] ABSTRACT

A suspension or rig for simultaneously setting a plurality of roof trusses on a building framing. A plurality of spaced vertical chains are suspended from a pair of horizontally extending pipes and connected to a central portion of each top sloping side of each truss, making two suspensions for each truss. A pair of horizontally extending spaced parallel pipes have ends connected to the pair of pipes. Suspending apparatus lifted by a crane comprises four linkage elements connected to end portions of the last mentioned pair of horizontally extending spaced parallel pipes. The pipes or beams may take other forms such as angle cross sections.

1 Claim, 3 Drawing Figures

ROOF TRUSS SUSPENSION

This invention relates to a lifting support frame for setting trusses by means of a crane.

In the past, great difficulty has been experienced in erecting and setting trusses, such as those for supporting roof structures of buildings and the like. The structure had to be assembled at the site of the building by lifting and setting in place one truss at a time involving considerable time and expense for erection, -also involving considerable danger of falling, -particularly the first truss installed.

An object of the present invention is to overcome the above-named disadvantages by means of a special rig of lifting support frame which is lifted by a crane for suspending and lifting a prefabricated or completely assembled roof truss at the construction site.

Figure 1:
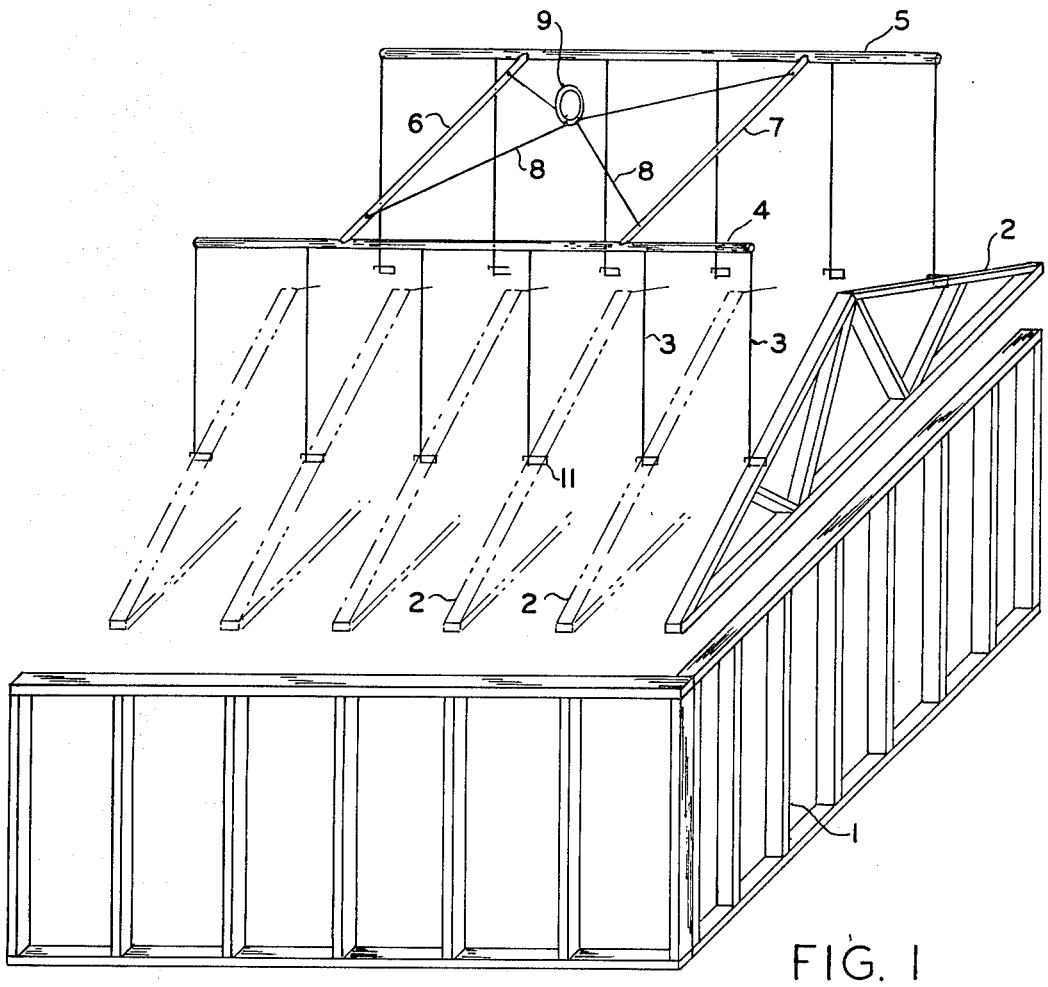
Figure 2:
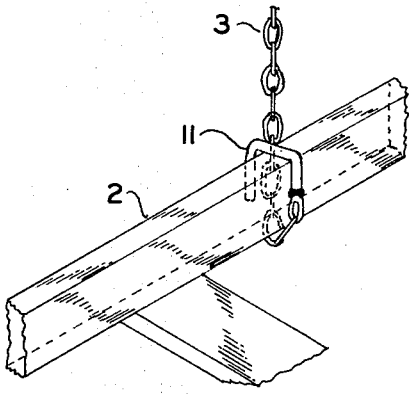
Figure 3:
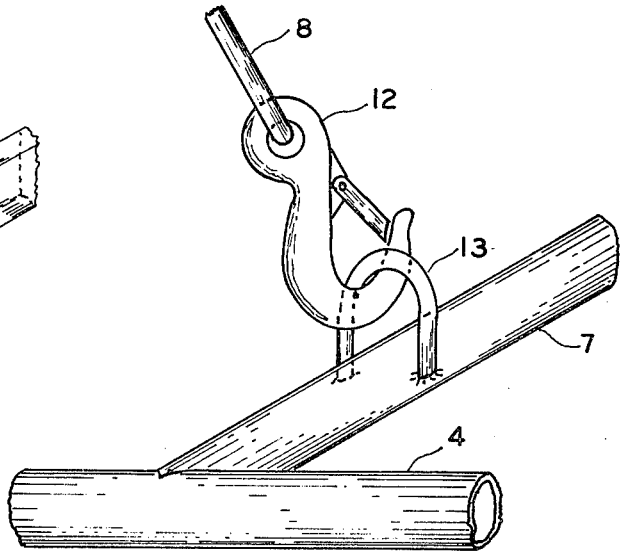

Other objects and advantages of the invention will become apparent from the following description, taken together with the accompanying drawing where:

FIG. 1 is a perspective view of a lifting support frame embodying my invention; and FIGS. 2 & 3 are enlarged, fragmentary perspective views showing connections.

Referring more particularly to FIG. 1, numeral 1 denotes the framing of the side-walls of a building, such as a house, factory, etc. Numeral 2 denotes a roof truss having angular cores. A plurality of such trusses are shown except that one is shown in complete detail and the others are illustrated in phantom outline since they are of identical construction and are set in spaced, parallel vertical planes.

A plurality of lifting steel link chains 3,3 are suspended from a lifting frame made up of steel pipes 4 and 5 which are in spaced parallel relationship and which are connected to steel pipes 6 and 7 at substantially right angles thereto. There are two lifting chains 3,3 for supporting the respective inclined top cores of each truss 2. FIG. 2 shows the connection at each top core comprising ½ round steel rod 11 which is welded to the end of chain 3. The tops of chains 3 are welded to steel pipes 4 and 5. Four lifting cables 8 are interconnected together at 9 which is connected to a lifting hook of a crane (not shown). The extremities of the cables 8 are each provided (FIG. 3) with a hook 12 which is connected to an inverted U-shaped lifting element 13 welded to intermediate portions of the lifting steel pipes 6 and 7.

In operation, therefore, as the crane lifts, through its conventional hook, (not shown) the joint 9, the lifting cables 8 will lift pipes 6 and 7 and the lifting frame 4,5,6,7 which, in turn, lifts the various steel link chains 3 which, in turn, lift the assembly of trusses. Because of the flexibility provided by the chains, frame and lifting cables, it is easy for the operator to move the entire truss assembly into exact position on top of the frames 1 and upon or immediately before setting, enabling slight corrections for proper setting of the various trusses onto the building frame 1.

While elements 4,5,6 and 7 have been illustrated, as pipes, they may be made of angles or other cross sections instead. They may have a plurality of spaced holes to allow the trusses to be set on 24 inch (or perhaps 16 inch) centers.

Thus it will be seen that I have provided an efficient rig that can be suspended from the hook of any conventional crane and that can lift the entire assembly of roof trusses simultaneously and in proper spaced relationship to each other so as to greatly reduce the cost of assembling the trusses; furthermore, I have provided a rig which eliminates the danger of assembling one roof truss at a time, as conventionally done, on a building framing.

While I have illustrated and described a single embodiment of my invention, it will be understood that this is by way of illustration only and that various changes and modifications may be contemplated in my invention and within the scope of the following claims:

I claim:

1. A rig for simultaneously setting a plurality of roof trusses on a building framing, comprising a pair of horizontally extending, spaced parallel beams adapted to extend over the respective central portions of the sloping sides of said trusses, a pair of cross beams at right angles to said beams and having ends connected to intermediate portions of said beams so as to provide overhanging extensions of said first mentioned pair of beams, a plurality of spaced vertical flexible linkage means suspended from each of the four overhanging extensions, and a plurality of spaced vertical flexible linkage means suspended from the intermediate remaining portions of said first mentioned pair of beams, and suspending means for support by the hook of a crane, said suspending means comprising four flexible linkage means extending from said hook and connected to end portions of each of said cross beams, a substantially U-shaped rod with parallel sides, which rod is attached to the lower extremity of each of said vertical flexible linkage means to enable the lower end portions of the vertical flexible linkage means to wrap around the central portion of the sloping side of the respective truss and to be secured by inverting said U-shaped rod and snugly encircling it over the top of the central sloping side of the respective truss so that said parallel sides closely fit the sides of said truss whereby the entire plurality of roof trusses may be easily and quickly lifted, lowered and moved horizontally to adjustably set them in place simultaneously on said building framing.

* * * * *